US005363009A

United States Patent [19]

Monto

[11] Patent Number: 5,363,009

[45] Date of Patent: Nov. 8, 1994

[54] INCANDESCENT LIGHT WITH PARALLEL GROOVES ENCOMPASSING A BULBOUS PORTION

[76] Inventor: Mark Monto, 1 Blueberry Bend, West Orange, N.J. 07052

[21] Appl. No.: 926,321

[22] Filed: Aug. 10, 1992

[51] Int. Cl.[5] ..... H01K 1/32

[52] U.S. Cl. ..... 313/110; 313/116; 362/317; 362/340

[58] Field of Search ..... 313/110, 116, 634, 635, 313/580; 220/2.1 R; 362/317, 335, 336, 337, 338, 339, 340, 255

[56] References Cited

U.S. PATENT DOCUMENTS

| | | | |
|---|---|---|---|
| 383,140 | 5/1888 | Moses | 313/110 |
| 597,964 | 1/1898 | Dunlap et al. | 313/116 |
| 2,782,297 | 2/1957 | Geissbuhler et al. . | |
| 2,963,612 | 12/1960 | Thorington | 313/116 |
| 3,221,162 | 11/1965 | Heenan et al. . | |
| 3,654,451 | 4/1972 | Starr . | |
| 3,662,208 | 5/1972 | Ohmae et al. | 313/112 |
| 3,761,957 | 9/1973 | Jarrett | 313/110 |
| 4,160,929 | 7/1979 | Thorington et al. | 313/112 |
| 4,210,841 | 7/1980 | Vodicka et al. | 313/221 |
| 4,300,068 | 11/1981 | Baird et al. | 313/315 |
| 4,315,186 | 2/1982 | Hirano et al. | 313/111 |
| 4,517,491 | 5/1985 | Otto et al. | 313/579 |
| 4,517,630 | 5/1985 | Dieffenbach et al. | 362/268 |
| 4,520,436 | 5/1985 | McNair et al. | 362/366 |
| 4,530,040 | 7/1985 | Petterson | 362/188 |
| 4,577,260 | 3/1986 | Tysoe | 362/61 |
| 4,638,208 | 1/1987 | Otto | 313/116 |
| 4,652,979 | 3/1987 | Arima | 362/80 |
| 4,690,141 | 9/1987 | Castel et al. | 128/396 |
| 4,703,403 | 10/1987 | Smith et al. | 362/268 |
| 4,728,848 | 3/1988 | Walsh | 313/113 |
| 4,734,836 | 3/1988 | Negishi | 362/311 |
| 4,965,488 | 10/1990 | Hihi | 313/499 |
| 5,252,886 | 10/1993 | Renarous et al. | 313/634 |

*Primary Examiner*—Donald J. Yusko
*Assistant Examiner*—Vip Patel
*Attorney, Agent, or Firm*—Thomas L. Adams

[57] ABSTRACT

An incandescent light has an evacuated envelope with a bulbous portion and a neck portion. The bulbous portion has a multiplicity of parallel grooves circling the bulbous portion longitudinally. The light also has an electrical filament centrally located in the bulbous portion of the envelope.

17 Claims, 1 Drawing Sheet

INCANDESCENT LIGHT WITH PARALLEL GROOVES ENCOMPASSING A BULBOUS PORTION

BACKGROUND OF THE INVENTION

The present invention relates to incandescent lights, and in particular to lights having light directing means on its envelope.

The emphasis on energy conservation has often focused on increasing the efficiency of lighting devices. Recent efforts to increase the efficiency of incandescent lights have had limited success.

Conventional incandescent light bulbs employ a glowing electrical filament inside of an evacuated glass envelope. Such light bulbs have been manufactured with transparent glass envelopes which make the incandescent filament visible. A disadvantage with this type of filament is the appearance of a very bright point source of light. This point source can cause glare when the light is used in a lamp fixture that does not have an effective diffuser.

To avoid the glare of a hot spot, known glass envelopes of incandescent lights have been "frosted" or etched to make the bulb surface itself a diffuser. Thus, the bulb surface appears as a diffuse source propagating light from the entire surface of the bulb. Because the light is thus diffused, bright spots and glare are reduced. Unfortunately, diffused light lacks the advantages of collimated light, which is sometimes helpful when examining objects or reading. For example, shadows cast from diffuse light are often blurry. When examining small three dimensional objects, sharp shadows can help reveal details of the object under examination. Accordingly, there is a need to reach a balance between diffused and collimated light.

Known spotlights have used an envelope with a parabolic reflector adjacent a glass window. For example, in U.S. Pat. No. 4,728,848 the glass window may be a Fresnel lens designed to focus the radiating light into a collimated beam. Spotlights of this type are inappropriate for illuminating a room. Were such a light installed in a conventional table lamp a focused beam would project upwardly to the ceiling but would not effectively illuminate the room.

Known light fixtures employ Fresnel lenses. These lenses help focus the light and increase the efficiency by directing light in a preferred direction. Again however, these fixtures are inappropriate for common applications such as table lamps. See for example U.S. Pat. Nos. 3,654,451 and 4,520,436.

In U.S. Pat. No. 4,734,836 an accessory mounted directly onto the envelope of a fluorescent tube employs a Fresnel lens grating. Again this device is designed to provide light flux in a preferred direction and is not effective for increasing the apparent efficiency for an incandescent room light.

See also U.S. Pat. No. 4,703,403 where a series of prisms encircle a cylindrical cover for an electric light. See also U.S. Pat. Nos. 2,782,297; 3,221,162; 3,662,208; 3,761,957; 4,160,929; 4,210,841; 4,300,068; 4,315,186; 4,517,491; 4,517,630; 4,530,040; 4,577,260; 4,652,979; 4,690,141; 4,965,488.

Accordingly, there is a need for an improved incandescent light that has a simple and effective means for enhancing efficiency.

SUMMARY OF THE INVENTION

In accordance with the illustrative embodiments illustrating features and advantages of the present invention, there is provided an incandescent light having an evacuated envelope and an electrical filament. The evacuated envelope has a bulbous portion and a neck portion. This bulbous portion has a multiplicity of parallel grooves circling said bulbous portion longitudinally. The electrical filament is centrally located in the bulbous portion of the envelope.

By employing such structure, an incandescent light with enhanced apparent efficiency is achieved. In a preferred embodiment, a light having the shape of a conventional household incandescent light bulb is engraved with a plurality of longitudinal grooves. These grooves circle the glass envelope of the preferred light parallel to what might be considered the equator of the light bulb when its neck is oriented vertically.

In the preferred embodiment, the grooves circle the entire bulbous portion of the incandescent light and the neck as well. The grooves can be made either externally or internally on the envelope of the incandescent light. Preferably, the groove to groove spacing is less than a 100th of a millimeter. By employing such grooves, the light bulb has an enhanced apparent efficiency, in that the bulb appears brighter to a room occupant. This brightness may result from a focusing of the light so that it is directed into the room more directly.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings wherein.

DETAILED DESCRIPTION OF THE PREFERRED EMBODIMENTS

Figure 1:
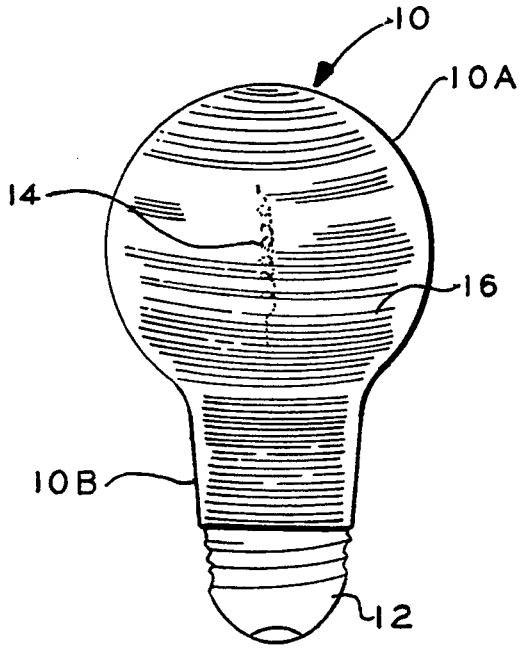
FIG. 1 is an elevational view of an incandescent light in accordance with the principles of the present invention.
Figure 2:
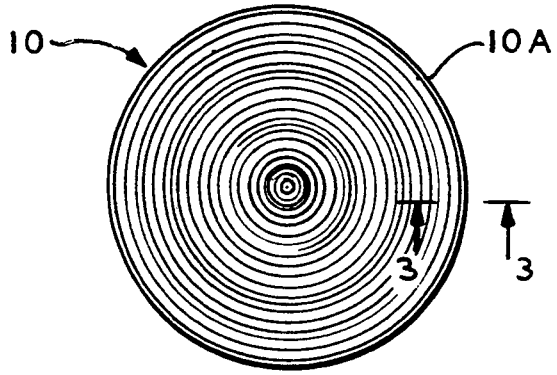
FIG. 2 is a top view of the light of FIG. 1.

Referring to the figures, an incandescent light is shown with a glass envelope 10 having a bulbous portion 10A and a neck portion 10B. The bulbous portion 10A is generally spherical while the neck portion 10B is generally cylindrical. Attached to neck 10 is a threaded shell 12 that includes a pair of electrical contacts, which connect to filament 14 mounted inside bulb 10. Filament 14 is supported on wires (not shown) that are embedded in a stem (not shown) fused to the end of the neck portion in the conventional manner. The stem and its filament support do not form a separate part of this invention.

The bulb envelope can be arranged to have a very small neck portion (for example, as in candelabra lights). In other embodiments, the neck portion will simply be an extremely small portion marking the transition between the main bulbous portion and the threaded electrical shell. Furthermore, the threaded shell can have various configurations and sizes including non-threaded versions, such as bayonet and pin-type bases.

A plurality of grooves 16 circle bulb 10. These grooves 16 are parallel and encompass all of the exposed surface of bulb 10, including the bulbous portion 10A and neck portion 10B. If the spherical bulbous portion 10A was considered to have poles aligned with the axis of the neck portion 10B, then the grooves 16 would all be considered parallel to the bulb's equator, that is, grooves 16 run longitudinally and could be considered lines of equal latitude.

Figure 3A:
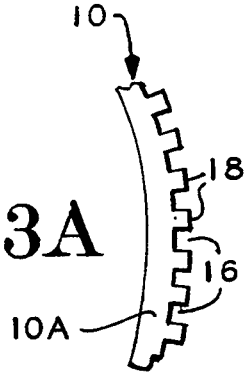
FIG. 3A is a cross-sectional view of the envelope of the light, taken along line 3—3 of FIG. 2.

FIG. 3A shows grooves 16 formed between a plurality of ridges 18. The grooves 16 can be formed in various ways, including photo etching and machining the bulb's surface. In some embodiments, the bulb can be molded with grooves 16. In other embodiments, a finished bulb can be modified by molding around it a surface layer having a number of ridges and grooves.

Suitably, the groove to groove spacing of grooves 16 is less than a tenth of a millimeter apart and preferably, less than a hundredth of a millimeter apart. Although preferred, the grooves can be eliminated from the neck portion 10B, in some embodiments. In other embodiments, the grooves may be placed on a limited area of envelope 10; for example the upper half of the bulbous portion 10A. Also in some embodiments, the grooves may be placed in a band centered around the "equator" (as that term was defined above) of the bulbous portion 10A. It is preferred however that the grooves cover at least half of the surface area of the bulbous portion. Additionally, in some embodiments the groove to groove spacing may vary over the surface of the bulb. For example, the intergroove spacing may be greater on top or vice versa.

Figure 3B:
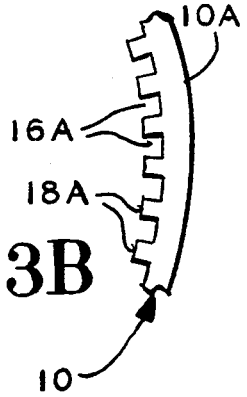
FIG. 3B is a cross-sectional view of the envelope, which is an alternate to that of FIG. 3A.

Referring to FIG. 3B, grooves 16A are shown shaped and spaced similarly to those illustrated in FIG. 3A but are placed on the inside of envelope 10. The internal grooves have an effect similar to the external grooves.

When the present light is illuminated, the grooves 16 on the envelope 10 diffract light and act much like a Fresnel lens. When viewed externally, the grooves 16 tend to magnify the filament. Thus from a distance, the filament seems to be larger, and therefore more diffuse. The filament however, is not completely diffuse and the light coming from the bulb 10 is collimated to a much greater extent than the "frosted" bulbs available commercially. Thus the light from the bulb appears to be brighter and has a better quality for reading or examining objects. Shadows tend to be sharper and the effectiveness of the light is enhanced. Accordingly, for a constant amount of electrical power input the present light produces an effective brightness greater than a conventional bulb.

The bulb can be used in ordinary light fixtures having shades or can be used without a shade in environments needing a more intense and less diffuse light.

It is to be appreciated that various modifications may be implemented with respect to the above described preferred embodiments. For example, the groove to groove spacing on the light envelope can be altered depending upon the manufacturing process and the desired degree of collimation. Also, the shape of the bulb can take various forms and the bulbous portion need not be spherical but can be a spheroidal, partially cylindrical, and shaped otherwise. Also, the neck can have a diameter that differs in proportion to the diameter of the bulbous portion, depending upon the application. Furthermore the various dimensions including the wall thickness of the envelope can be altered depending upon the desired strength, rigidity and diffusion and collimating characteristics. Moreover, the light can be adapted to have one or more filaments and thus can be arranged to act as a three way light.

Obviously, many modifications and variations of the present invention are possible in light of the above teachings. It is therefore to be understood that within the scope of the appended claims, the invention may be practiced otherwise than as specifically described.

I claim:

1. An incandescent light bulb comprising:

an evacuated envelope having a bulbous portion and a neck portion for containing a vacuum, said bulbous portion having a multiplicity of parallel grooves circling said bulbous portion longitudinally for focusing and directing light, said envelope at said bulbous portion having an opposing pair of external and internal surfaces, said bulbous portion being substantially ungrooved on one of said pair of surfaces, the other one of said pair of surfaces of said envelope having said grooves formed integrally thereon, said grooves alternating with ridges formed without an underlying gap on said envelope to act as a Fresnel lens, said ridges each having a wall extending between a distal corner at said ridge and a proximal corner at said groove; and an electrical filament centrally located in said bulbous portion of said envelope.

2. An incandescent light according to claim 1 wherein said grooves are spaced to act as a Fresnel lens.

3. An incandescent light according to claim 2 wherein said grooves are internal to said bulbous portion.

4. An incandescent light according to claim 2 wherein said grooves are external to said bulbous portion.

5. An incandescent light according to claim 2 wherein said grooves have a groove-to-groove spacing of less than a tenth of a millimeter.

6. An incandescent light according to claim 5 wherein said grooves have a groove-to-groove spacing of less than a hundredth of a millimeter.

7. An incandescent light according to claim 2 wherein said grooves occupy at least half the surface of said bulbous portion.

8. An incandescent light according to claim 7 wherein said grooves have a groove-to-groove spacing of less than a tenth of a millimeter.

9. An incandescent light according to claim 8 wherein said grooves have a groove-to-groove spacing of less than a hundredth of a millimeter.

10. An incandescent light according to claim 9 wherein said grooves are internal to said bulbous portion.

11. An incandescent light according to claim 9 wherein said grooves are external to said bulbous portion.

12. An incandescent light according to claim 7 wherein said grooves occupy all said bulbous portion.

13. An incandescent light according to claim 12 wherein said grooves occupy an area on said bulbous portion opposite said neck portion.

14. An incandescent light according to claim 13 wherein said grooves occupy an area on said neck portion.

15. An incandescent light according to claim 2 further comprising:

a shell electrically connected and adapted to convey power to said filament.

16. An incandescent light according to claim 15 wherein said shell is externally threaded.

17. An incandescent light according to claim 15 wherein said neck portion is completely encompassed by said shell.

* * * * *